US005155923A

United States Patent [19]

Wireman et al.

[11] Patent Number: 5,155,923

[45] Date of Patent: Oct. 20, 1992

[54] APPARATUS AND PROCESS FOR CONDITIONING PARTICULATE MATERIAL

[75] Inventors: Jack Wireman; Daniel R. Wireman, both of Fallbrook, Calif.

[73] Assignee: Blaw Knox Food & Chemical Equipment Company, Buffalo, N.Y.

[21] Appl. No.: 691,433

[22] Filed: Apr. 25, 1991

Related U.S. Application Data

[62] Division of Ser. No. 463,557, Jan. 11, 1990, Pat. No. 5,068,979.

[51] Int. Cl.[5] ..... F26B 5/08

[52] U.S. Cl. ..... 34/8; 34/10; 426/466

[58] Field of Search ..... 34/58, 8, 57 R; 427/213; 49/483; 426/467, 311, 519, 520, 466

[56] References Cited

U.S. PATENT DOCUMENTS

| | | | |
|---|---|---|---|
| 373,140 | 0/1887 | Jepson . | |
| 2,326,094 | 8/1943 | Cusack et al. . | |
| 3,200,737 | 8/1965 | Ferenc . | |
| 3,207,494 | 9/1965 | Jager . | |
| 3,500,553 | 3/1970 | Farkas et al. . | |
| 4,103,432 | 8/1978 | Dieterich et al. . | |
| 4,130,944 | 12/1978 | Hultsch et al. . | |
| 4,189,850 | 2/1980 | Dieterich et al. . | |
| 4,532,155 | 7/1985 | Golant et al. | 34/57 E |
| 4,682,423 | 7/1987 | Gager . | |
| 4,691,448 | 9/1987 | Alstetter et al. . | |

*Primary Examiner*—Henry A. Bennet
*Attorney, Agent, or Firm*—Bacon & Thomas

[57] ABSTRACT

A controlled spinning bed of particulate material such as coffee beans or the like is formed and maintained in a stationary chamber, the particulate material is mixed nd uniformly conditioned. For example, coffee beans are uniformly roasted within a relatively short time and coolded in a similar but separate chamber with or without an intermediate quench.

27 Claims, 8 Drawing Sheets

30
31
34
32
6'
33
42
5
4'
6'
27'
60
37
52
39

FIG. 9
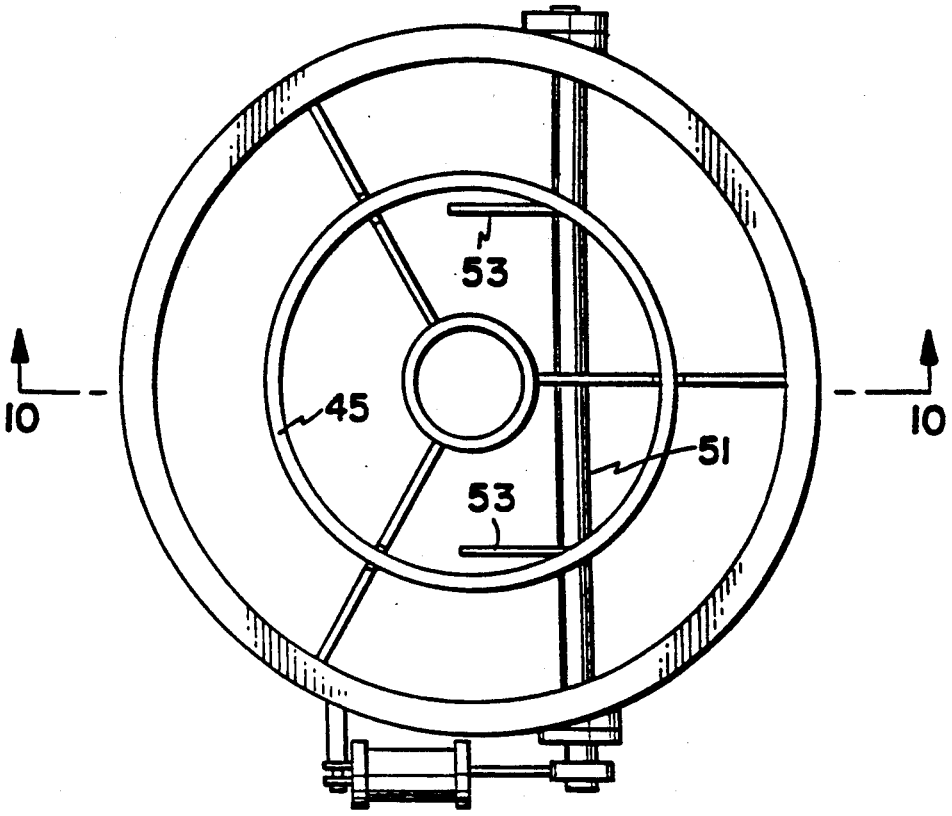
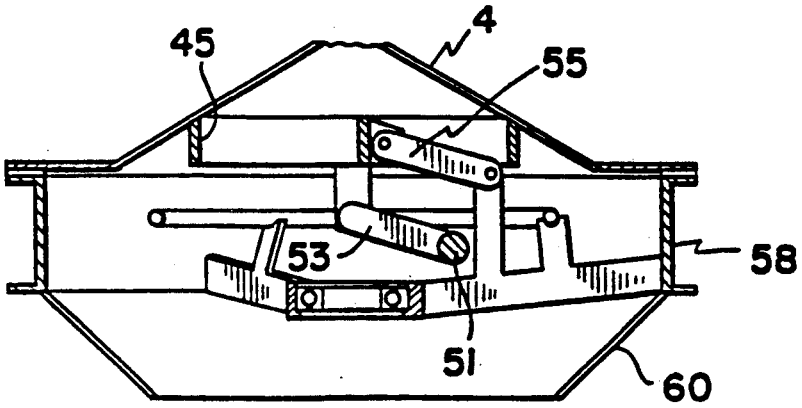
FIG 10

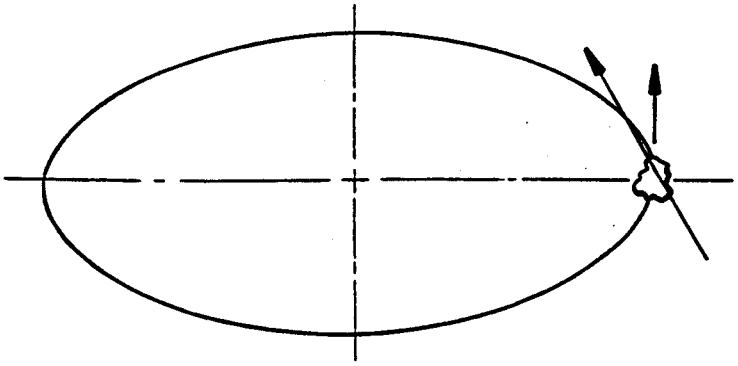
FIG. 12
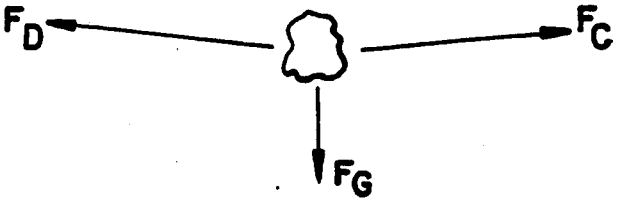
FIG. 13
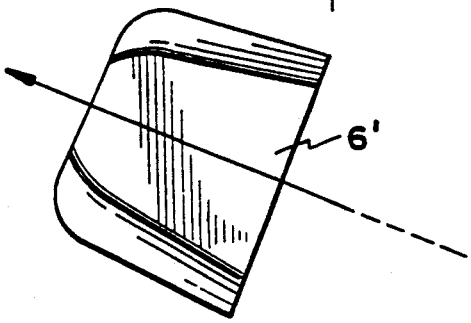
FIG. 14
FIG. 14a
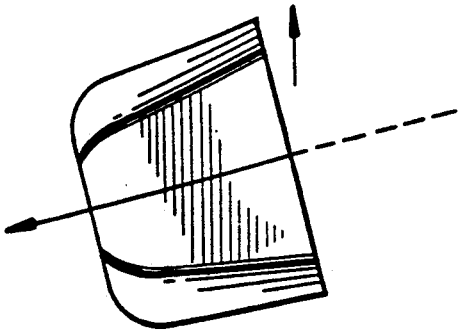
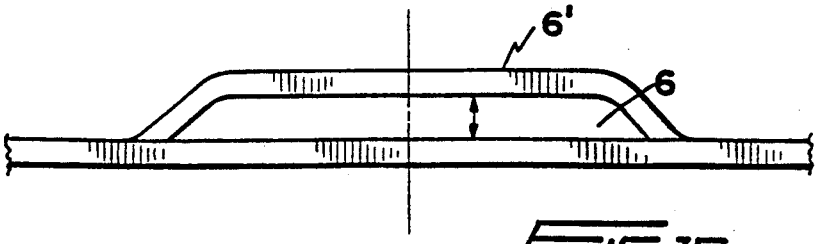
FIG. 15

APPARATUS AND PROCESS FOR CONDITIONING PARTICULATE MATERIAL

This application is a division of application Ser. No. 07/463,557, filed Jan. 11, 1990 now U.S. Pat. No. 5,068,979.

This invention relates to an apparatus and process for conditioning particulate material and more particularly to an apparatus and process for forming, heating and/or cooling an controlled spinning bed of particulate vegetable material.

BACKGROUND OF THE INVENTION

It is presently believed that the apparatus and process according to the present invention will have broad application in the field of food processing and perhaps beyond that field. For example, there are problems in drying rice, roasting nuts and coffee that may be overcome by the apparatus and processes disclosed herein. Nevertheless, the novel apparatus and processes disclosed herein are known to offer a number of advantages which are peculiar to coffee roasting. Accordingly, the initial development efforts have been directed to that field and the description of the preferred embodiments of the invention will emphasize coffee roasting without in any way limiting the broader aspects of the invention. Other applications will be readily apparent to those who are skilled in the art of treating particulate material.

In its simplest form, coffee roasting comprises heating a single bean to a prescribed temperature at which point chemical reactions occur that transform the bean into the desired state of pyrolysis. These reactions occur in the last part of the heating cycle. Thus, the residence time at the terminal temperature is crucial because a difference in a few seconds in heat-history can have a significant effect on the taste of the coffee.

The problem is that it is difficult to design a roaster that will roast several hundred pounds of beans at one time and to roast every bean evenly. Whether the process for heat transfer is from convection, conduction, radiation, or some combination thereof, the heat is absorbed in the first few layers of a bean bed. Therefore, it is desirable to establish some means for equalizing bean temperature throughout the heating cycle so that when the final roasting temperatures are approached, all of the beans will be close to the same temperature during the pyrolysis process.

The prior art is replete with attempts to obtain roasting uniformity. For example, various approaches for roasting coffee are set forth in U.S. Pat. No. 2,857,683 of Schytil.

In the aforementioned prior art processes, the heating time to reach critical temperatures were considered to be relatively unimportant. For example, prior art processes typically roasted coffee beans for periods of six to twenty minutes. However, in recent years, it has been found that coffee beans expand more and result in lower roast bean density if the heating process is speeded up to where the total heating cycle is accomplished in as short a time period as possible consistent with acceptable product characteristics, preferably within 70–90 seconds. Further, it has been found that these light density beans, when ground, have increased extractable solids and wettability, thus yielding an increase in extractable solids than when employing conventional time and temperature brewing devices. The result of fast roasting is that coffee processors can fill the traditional 16 ounce container with a much reduced weight of coffee that still results in an equivalent number of cups as 16 ounces resulting from a longer roasting process.

Therefore, it is presently believed that there is a significant demand for an apparatus and/or process which will raise the coffee bean temperature to a specified point, maintain a more uniform temperature across a bed of beans and complete the roast in a time period which is almost an order of magnitude shorter than conventional roasting of a few years ago. It is also believed that such apparatus will have broad application for roasting and drying vegetable products and for treating other materials.

One approach to the more rapid roasting of coffee beans is disclosed in the U.S. Pat. No. 4,737,376, of Brandlein et al. As disclosed therein, the beans have a residence time within the roaster for a period of much less than three minutes and perhaps less than 1.5 minutes. During roasting, the beans are subjected to a flow of heated gas which passes upwardly through a first foraminated container at a mass flow rate of at least ten pounds of gas per pound of beans. In that process, the depth of the expanded bed is less than 50% of the diameter of the container. Further apparatus for the fluidized bed roasting of coffee is disclosed in the U.S. Pat. No. 3,964,175, of Sivetz. The Sivetz disclosure also contains a survey of prior art fluid bed roasters.

The efforts to obtain faster roasting have for the most part relied on the use of a fluidized bean bed and hot air. However, attempts to drive the requisite amount of air needed for fast heating through the bed causes the bed to become unduly levitated and change into a spouting bed. This undue levitation and spouting results in a substantial loss in heating efficiency. Also, the individual beans in such systems are thrown about in a random fashion which adversely affects the uniformity of the roast.

Another approach for roasting coffee beans uses a downblast of hot air into the beans instead of fluidization. This approach, like fluidization, produces random bean movements and results in a lack of bean uniformity. For example, such roasters have been found to produce coffee having several color units of variation because the beans are blown backward as well as forward and therefore receive different amounts of heat.

There is one further consideration for roasting coffee beans and for heating and/or drying particulate vegetable material. In some cases, a continuous roaster is favored. Such roasters are typically very large in size and capable of roasting 10–12,000 pounds per hour. Thus, the machines take up a large amount of floor space, are suitable for large processing plants and are relatively inflexible. For example, such machines are not usually readily changed over for producing different roasts or the like. Batch machines, on the other hand, are more appropriate for a majority of roasting shops which produce a plurality of products or blends. The reason is that many coffee processors operate like a typical job shop where there are many changes during the day of blends, type of roast, degree of roast, etc., with relatively short runs of each. In addition, the smaller shops do not generally need the large capacity of a continuous roaster.

Thus, it appears that there is a need for an improved apparatus and method for uniformly conditioning particulate material. For example, it is believed that there is a need for an improved apparatus and method for uniformly roasting batches of coffee very rapidly and with an efficient use of energy. It also appears that there is a demand for improved conditioning, cooling, heating and roasting apparatus which is relatively flexible, competitively priced, relatively simple in operation, free of complexity and easy to operate and maintain. Also, it appears that there is a demand for improved apparatus and methods which will occupy a relatively small area and which can be rapidly converted to operate under different conditions in a job shop type of operation while fulfilling all of the requirements for food processing.

It is presently believed that the apparatus and methods to be described hereinafter will meet most, if not all, of the aforementioned criteria.

SUMMARY OF THE INVENTION

In essence, the present invention contemplates an apparatus for conditioning particulate material which includes a chamber for receiving a charge of particulate material. The apparatus also includes means for forming a controlled spinning bed of the material within the chamber and with relative motion between the spinning bed and the chamber. Means are also provided for subjecting the controlled spinning bed of material to a conditioning step such as heating and for removing the conditioned material from the chamber.

The chamber, according to a preferred embodiment of the invention, has a generally circular base and an upwardly extending divergent wall defining a segment of a cone with a central axis and closed bottom. The divergent chamber wall preferably forms an included angle with respect to a horzontal plane of between 45°-85° and also defines a plurality of openings in a lower portion thereof. Also in accordance with a preferred embodiment of the invention, means are provided for inducing a mass of heated fluid generally tangentially into the chamber to rotate the particulate material about the central axis of the chamber and for maintaining the rotating material in a relatively densely packed or controlled state during the heating thereof. During the rotation of the particulate material, the chamber is relatively stationary, i.e., it does not rotate about its central axis so that there is relative movement between the rotating material and the stationary chamber. In addition, there is also vertical and radial movement of the particulate material with respect to the chamber in the preferred embodiment.

The invention also contemplates a process for conditioning and/or heating and/or roasting particulate material such as coffee beans or the like. The process includes the step of providing a generally upright chamber having a central axis and the step of introducing a charge of coffee beans or the like into the generally upright chamber. The process also includes the steps of forming and/or maintaining a controlled spinning or centrifugally packed bed of coffee beans or the like and heating the spinning bed to an appropriate temperature of, for example, about 221° C. (430° F.) for roasting coffee beans. In a final step, the heated or roasted beans are removed from the chamber. However, it should be noted that the beans may be cooled or quenched within the chamber or after removal therefrom. It is also contemplated that a second chamber may be provided for subsequently treating and/or rapidly cooling the particulate material.

BRIEF DESCRIPTION OF THE DRAWINGS

The invention will now be described in connection with the accompanying drawings, in which:

FIG. 9 is a plan view illustrating a means for removing particulate material from the roasting chamber shown in FIG. 8;

FIG. 10 is a cross-sectional view illustrating the means for removing particulate material shown in FIG. 9;

FIG. 12 is a schematic diagram which illustrates the path of a particle in a spinning controlled bed;

FIG. 13 is a schematic diagram which illustrates the forces acting on the particle shown in FIG. 12;

FIG. 14 is a diagrammatic view illustrating the positioning of a louver according to a preferred embodiment of invention;

FIG. 14*a* is a diagrammatic view illustrating the positioning of a second louver according to a preferred embodiment of invention; and FIG. 15 is a cross-sectional view of the louver shown in FIG. 14 taken along line 15—15.

DETAILED DESCRIPTION OF THE PREFERRED EMBODIMENTS OF THE INVENTION

Figure 1:
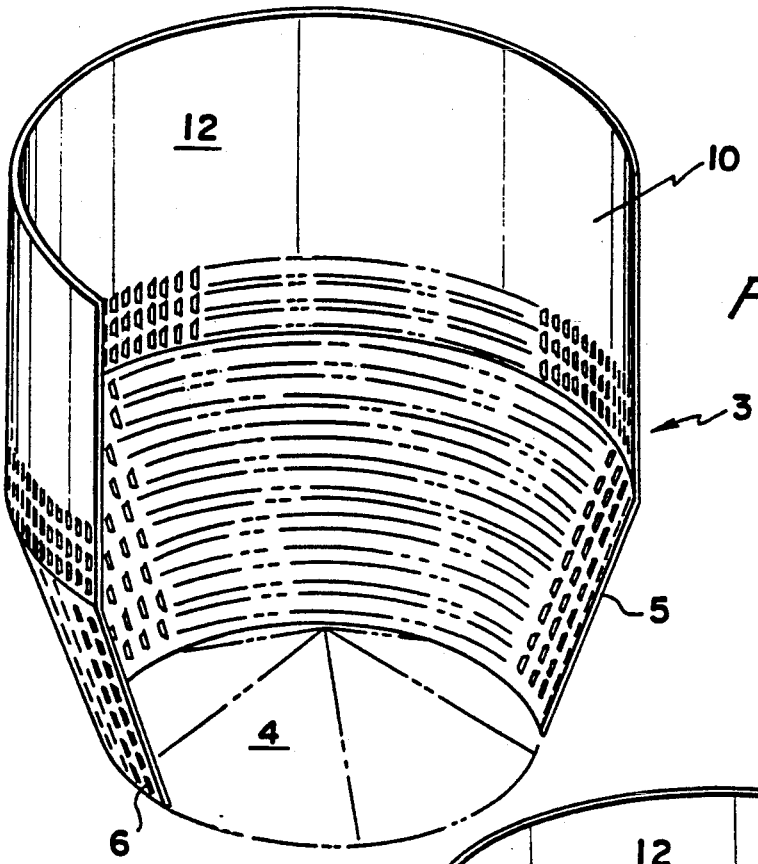
FIG. 1 is a partially broken away perspective view of a chamber which is incorporated in a first embodiment of the invention.

In considering convection heat transfer to particles in a bed, heat transfer texts show that the best heat transfer coefficient occurs when the porosity of the whole bed is at a minimum. This minimum porosity occurs in a packed bed, i.e., when the amount of open space between all of the particles is taken with the particles piled at rest. However, in roasting coffee beans in a fluid bed, the updrafted air lifts or levitates the beans and spouting (the equivalent of bubbling in a boiling liquid) occurs long before the proper amount of air can be circulated to produce a fast roast, i.e., a complete uniform roast within 60 to 90 seconds.

Thus, the present invention contemplates an apparatus and process which will maintain the beans in a relatively packed bed condition during heating or roasting and, at the same time, provide good turning or mixing of the beans within the bed to obtain temperature equilibrium. In essence, the apparatus and process disclosed herein have been designed in an endeavor to raise each bean in the bed to the same temperature and to subject each bean to the same heat history.

The controlled spinning bed as defined herein is a quasi-packed bed, i.e., it approaches the porosity of a packed bed, but is constantly moving about a central and preferably vertical axis. For example, in a controlled spinning bed, the beans have an apparent weight which is equal to or greater than the lifting drag of the air passing over the beans. Thus, the controlled spinning bed provides a well-ordered movement of each of the particles therein and essentially eliminates the random movement of particles which is associated with a fluid bed. A controlled spinning bed in accordance with a preferred embodiment of the invention also causes the particles in the outer portion of the bed to move upwardly in a spiral direction while those in the upper portion of the bed are directed and/or moved downwardly to the bottom of the bed.

In addition, a controlled spinning bed in accordance with a preferred embodiment of the invention provides a centrifugal force component which is several times that of gravity. This apparent weight increase is believed to improve the heat transfer process by allowing the passage of a relatively large amount of air at a relatively high velocity to pass through the bed without causing apparent weightlessness and its attendant spouting or fluidization. Thus, the controlled spinning bed differs from the conventional fluidized bed wherein individual particles are lifted upwardly by the fluid flow and are subjected to a period of apparent weightlessness.

This elimination of spouting and/or fluidization is desired since the best heat transfer occurs when the porosity of the whole bed is at a minimum, i.e., when the amount of open space between the beans is approximately the same as when the beans are piled at rest. However, it should be recognized that some minimal spouting that is over perhaps about 5% of the surface may occur without departing from the scope of the claims.

Thus, the controlled spinning bed differs from the conventional fluidized bed wherein individual particles are lifted upwardly by the fluid flow drag and are subjected to a period of apparent weightlessness. The spinning controlled bed also differs from a conventional packed bed since the controlled spinning bed provides relative movement between the particles which transfers heat throughout the bed and allows a much greater velocity of air to pass through the bed without levitating the particles.

In a controlled spinning bed in accordance with a preferred embodiment of the invention there is also relative movement between the bed and the chamber along a plurality of axes. For example, the spinning bed moves rotationally around the central axis of a stationary chamber while beans within the bed move upwardly and after encountering a bean spill (to be described hereinafter), downwardly. It is also apparent that there is some radial movement of the beans, i.e., outwardly from the inner surface of the bed toward the wall while other beans that have slowed down move inwardly in a more or less radial direction.

In roasting coffee, it is desirable to transfer a certain amount of heat into the beans in a given amount of time. And, when it is desired to roast coffee in a very short period of time, there are essentially two alternatives. First, the temperature can be increased. However, increasing the temperature above a given level will burn the surface of the bean and at times cause a fire and/or explosion. The second alternative, which is utilized in the present invention, is to increase the velocity of hot air across the bean without driving the bean out of the bed. Thus, the film coefficient is higher than in a fluidized bed and the relative movement of the particles in the controlled spinning bed improves the heat distribution throughout the bed by mass transfer.

It is also believed that the use of a lower temperature, i.e., an air temperature of between about 550°-650° F. (287°-343° C.) across the beans, provides better control of the roasting process, results in energy savings and a safe operation, i.e., with a substantial reduction in the risk of fire.

A coffee roaster (FIG. 7), according to a first embodiment of the invention, will now be described in connection with the accompanying drawings wherein like reference numerals have been used to designate like parts.

A coffee roaster 2 comprises a generally upright chamber 3 (FIGS. 1 and 2) which is adapted to receive a charge of coffee beans. The chamber 3 has a generally circular base 4 and an upwardly extending divergent wall 5 which defines a segment of a cone with a central axis (not shown). The circular base 4 may as illustrated define a relatively shallow cone which extends upwardly into the chamber so that any coffee beans falling thereon will flow outwardly toward the upwardly extending wall 5 of chamber 3.

Figure 2:
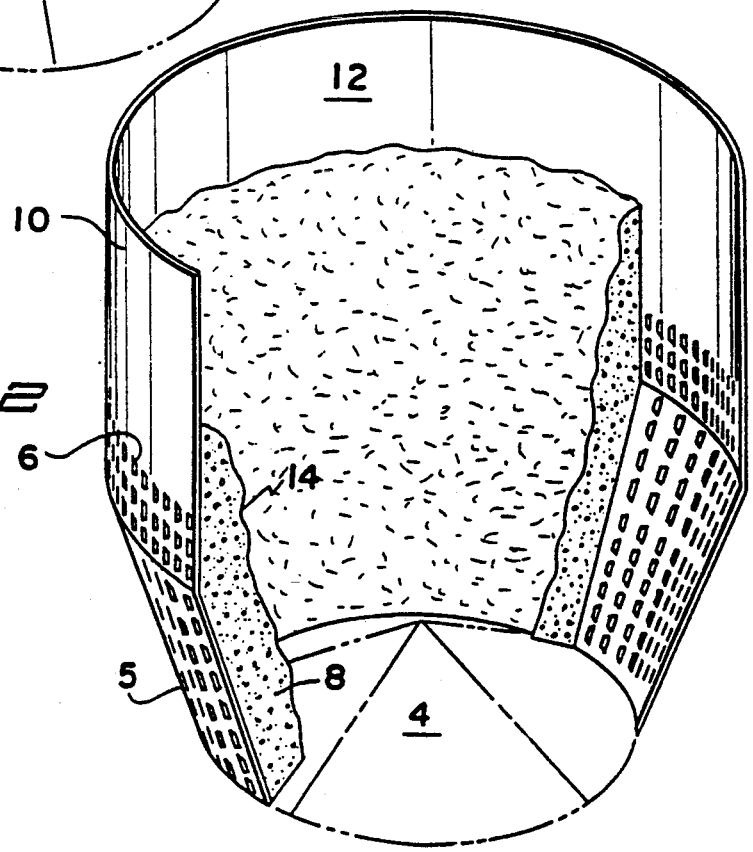
FIG. 2 is a partially broken away perspective view of the chamber shown in FIG. 1, but which includes a controlled spinning bed of particulate material therein.

A lower portion of chamber 3 also defines a plurality of openings 6 or preferably louvers 6' which are adapted to receive a mass of air. For example, heated air is induced tangentially into the chamber 3 through the opening 6 to form and maintain a spinning controlled bed of beans 8 as illustrated in FIG. 2 and which will be described more fully in connection with FIGS. 3 and 4.

Figure 8:
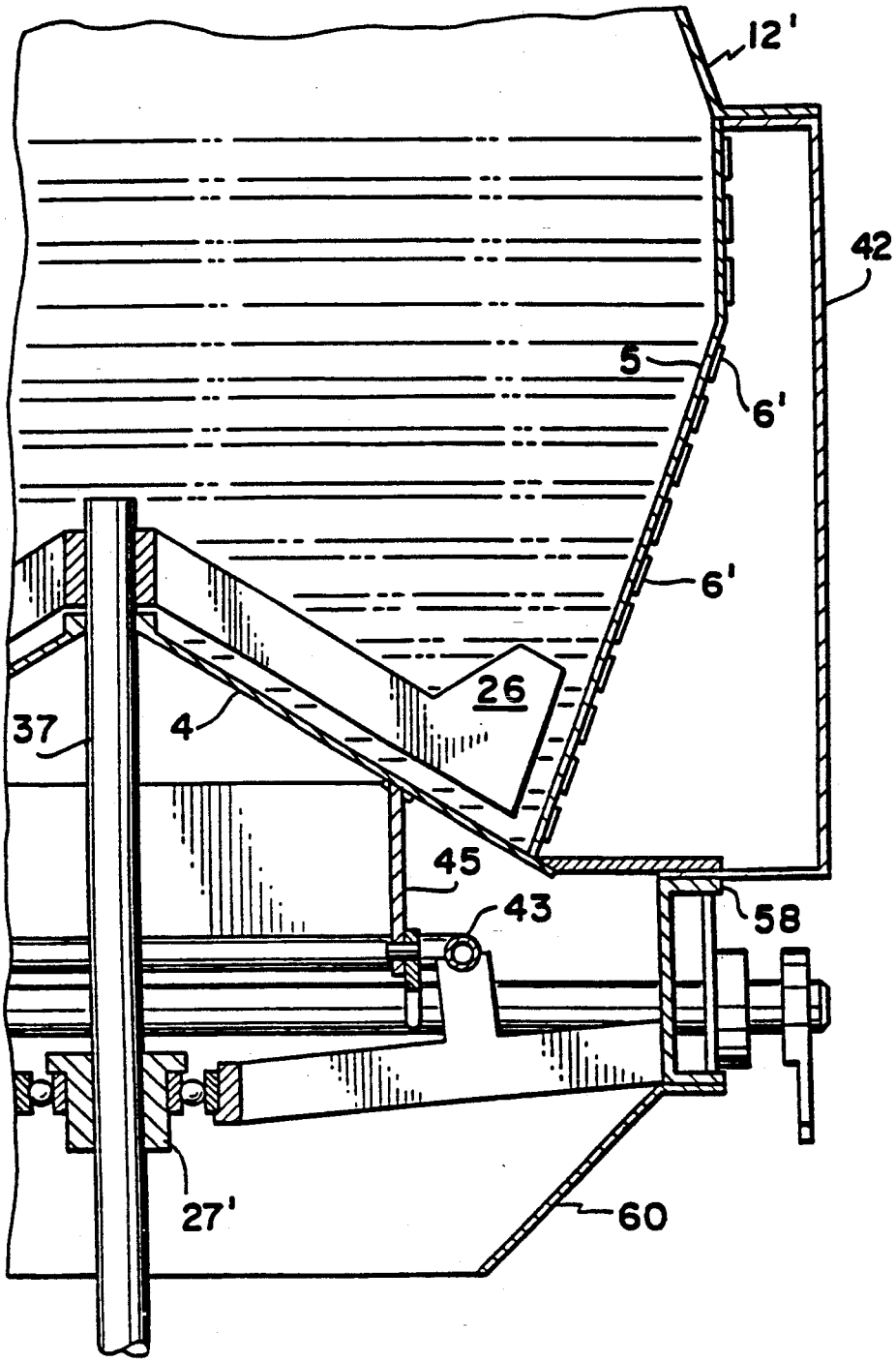
FIG. 8 is a cross-sectional view which is partially broken away of the roasting section of the coffee roaster shown in FIG. 7.

The chamber 3 also includes an upper portion 10 which is coaxial with the lower portion and which includes an upwardly extending wall 12. This upwardly extending wall 12 may define a right circular cylinder, a conical section wherein the slope of wall 12 is greater than the slope of wall 5 or a reverse conical segment 12' (FIG. 8). In some cases, it may be possible to substitute a relatively flat lid with a central opening or in other cases to eliminate the upper portion 10. In the latter case, the conical segment of the lower portion would be extended to a greater height and the upper portion thereof would be free of openings or louvers.

Figure 3:
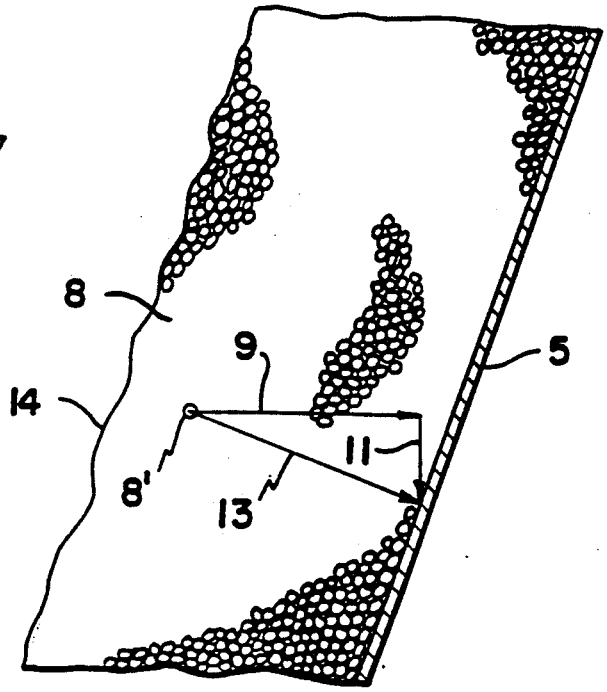
FIG. 3 is a schematic vertical section of the bed shown in FIG. 2 with a force diagram superimposed thereon.

The purpose of the upper portion 10 is to stop the upward climb of the beans along the wall 5. The beans in the bed will preferably move spirally upwardly along the wall 5 because of the centrifugal force component on the bed. For example, a diagram in FIG. 3 illustrates the forces working on a single bean 8' in the bed 8. As illustrated therein, the bean 8' is rotated about the central axis of the chamber 3 by means of the tangentially induced air and is subjected to a centrifugal force component 9 which forces the bean outwardly toward the wall 5. The weight of the bean 8' produces a vertical component 11. Thus, there is a resultant force 13, which is due to the gravity and centrifugal acceleration. In accordance with the preferred embodiments, this resultant force should be approximately normal to the wall 5 or have a slight upward component which will force the bean within the spinning bed to climb upwardly along a spiral path along wall 5. Thus, the forces acting on the beans in bed 8 cause the beans to climb the cone-shaped chamber and form a free surface 14 which is approximately parallel to the wall 5.

Thus, the purpose of the air is two-fold. First, the air imparts sufficient velocity to the beans to maintain the spinning bed; and, second provides heat transfer to the beans. In practice, the air spins the beans about the central axis fast enough so that the centrifugal force component is several times that of gravity. This apparent weight increase is important for heat transfer and permits a substantial amount of air to pass though the bed without levitating the beans. In fact, the result is a relatively stable spinning bed in which the beans follow a relatively defined path, remain in a relatively dense bed with a flow of gas through the bed and with controlled mixing which provides a uniform roast so that each of the beans in the bed experience essentially the same heat history.

Figure 4:
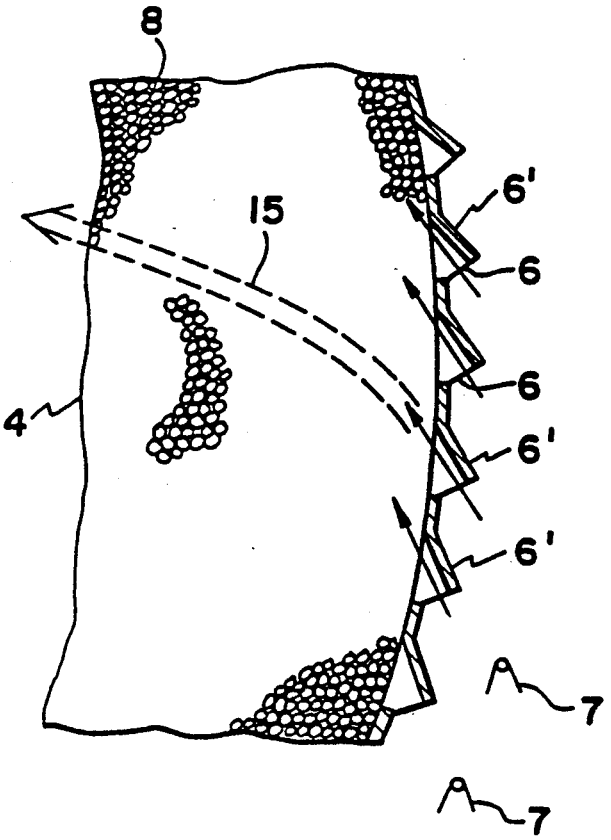
FIG. 4 is a schematic horizontal section of the bed shown in FIG. 2 illustrating the direction of fluid mass flow in one embodiment of the invention.

The air flow of the heated air through the bed 8 is illustrated in FIG. 4. As illustrated, the cross section is normal to the axis of the cone and thus shows a horizontal slice taken from a portion of bed 8. As shown therein, the high velocity heated air enters the chamber 3 generally tangentially through the opening 6, past louver 6' and passes through the bed 8 as illustrated by arrow 15. For example, air which is preheated to 550°-650° F. (287°-343° C.) enters the chamber 3 through opening 6 at, for example, approximately 100-125 feet per second while the beans are travelling at approximately 10 feet per second. As a result, there is a high relative scrubbing in the layer of beans next to the chamber and a very high film coefficient of heat transfer. Also, as the air transfers its momentum to the beans, it slows and follows a generally curved path 15 through the bed and exits in a direction which is approximately normal to the inner surface of the bed 8. At that point, its velocity has decreased to about 10 feet per second which is insufficient to uplight or levitate the beans. Suitable means such as a plurality of nozzles 7 (FIG. 4) direct the air toward the louvers 6' so that the air enters the chamber in a mostly tangential direction.

Once established, the bed will remain in essentially dynamic equilibrium with a minimal amount of recirculation as the beans in the outer portion of the bed spiral upwardly and those on the inner portion spiral downwardly. Thus, a stable spinning bed as described above can be established and maintained by selecting the slope of the chamber wall, diameter of the chamber and air velocity. For example, with a larger load of coffee beans, the beans in the inner free surface will be subjected to the effects of gravity more so than those at the outer edge of the bed, i.e., closest to the chamber wall.

Figure 5:
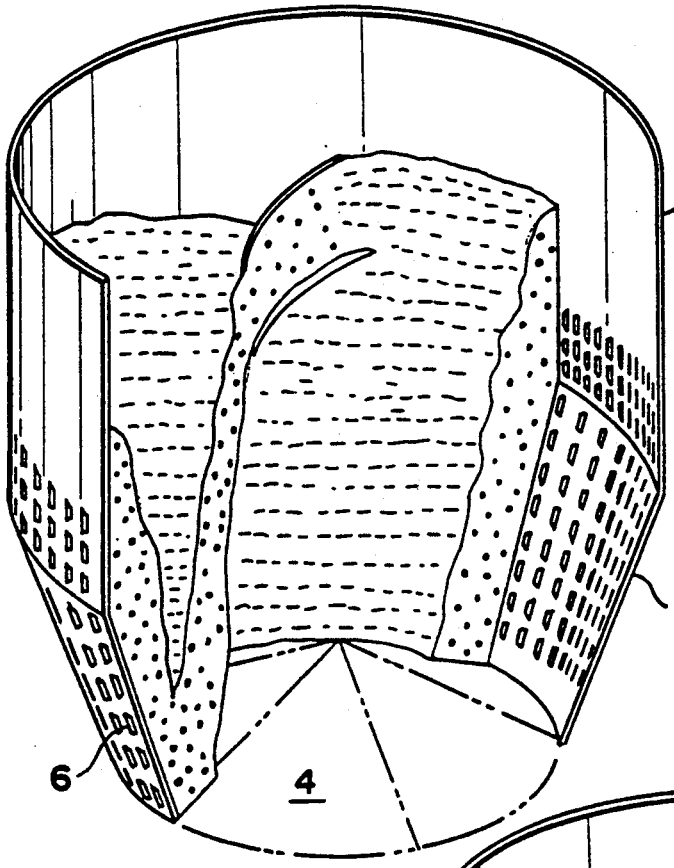
FIG. 5 is a partially broken away perspective view of the chamber shown in FIG. 2, but which includes means for mixing the material in accordance with a second embodiment of the invention.

To accommodate different loads and obtain uniform roasting during a relatively short roasting cycle, it is desirable to increase the mixing of the beans within the bed. For this reason, it is desirable to add separate mixing means to mechanically turn and mix the bed. FIG. 5 illustrates a mechanical mixing means or bean spill 20 which is partially broken away to illustrate the movement of the beans within bed 8. The bean spill 20, as illustrated, is a curved metallic plate which may curve downwardly as illustrated and which may be fixed to the wall 12 in any manner which will be apparent to those skilled in the art. The spill 20, as well as the chamber 3, are relatively stationary with respect to the spinning controlled bed 8. For example, the chamber 3 and spill 20 are preferably stationary except for vibration.

The spill 20 is mounted at a level where it will intersect and extend down into the upper portion of the spinning bed 8. Thus, the spill 20 interrupts the top layer of beans in an outer portion of bed 8 and directs the stream back to the bottom of the bed. And, in accordance with one preferred embodiment of the invention, the spill 20 is constructed and arranged so that the recirculation rate is large enough to totally turn over the bed in a matter of several seconds for good temperature equilibrium.

The spill 20 causes the beans to be recirculated in a controlled manner wherein the beans follow a prescribed path. This spill 20 is also useful in batch type of operations when it is frequently desired to produce various blends of coffee. In such operations, a coffee processor will mix different type of beans such as Columbian and Brazilian to obtain a particular flavor. However, by using the apparatus disclosed and claimed herein, each type of bean can be added to the roaster or hopper without premixing and the spinning controlled bed, in cooperation with the bean spill, will produce a uniform blend of uniformly roasted coffee.

Figure 6:
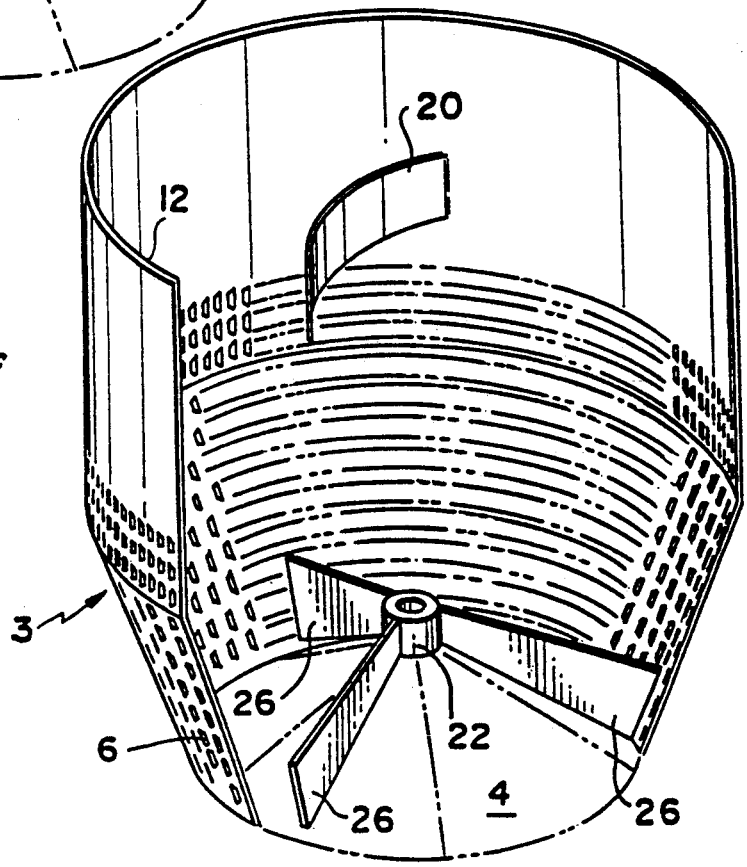
FIG. 6 is a partially broken away perspective view of a chamber, mixing means and mechanical means for assisting in the rotation of a centrifugally packed bed in accordance with a preferred embodiment of the invention.

A further embodiment of the invention is illustrated in FIG. 6. This embodiment is particularly applicable for coffee processors who need a degree of flexibility in processing different loads. For example, such processors may be called upon to roast relatively light to relatively heavy loads of coffee. Therefore, to accommodate a relatively wide range of loading, a mechanical mixing or stirring device 22 has been added to chamber 3. The mixing device 22 comprises a central rotatable hub 24 and a plurality of paddles 26. The paddles are constructed and arranged to fit relatively closely to the wall 5 and conical base 4 and to rotate about the central axis of chamber 3. These paddles mechanically push the recirculated beans back into the bed at loadings other than optimum. The paddles 26 also help to start the whole bed 8 spinning at the beginning of a roasting operation.

The operation of the apparatus according to the presently preferred embodiments of the invention will be described in more detail in connection with FIGS. 7 through 12. For example, approximately 50 pounds of green coffee beans are loaded into a cylindrical hopper 30. This hopper 30 may be approximately 16 inches in diameter with a height of about 12 inches and includes a conical-shaped lower portion 31 which would, if extended to an apex form an angle of about 90°. It is also desirable to have a closable opening at the bottom of about 5.5 inches so that the 50 pounds of beans can be dumped into the roasting chamber 3 within about 3 seconds. In essence, it is desirable to charge the roaster as fast as possible to minimize dead time in between roasting. A roaster as described would, for example, have a capacity of about 700 to 1000 pounds of coffee per hour.

Figure 7:
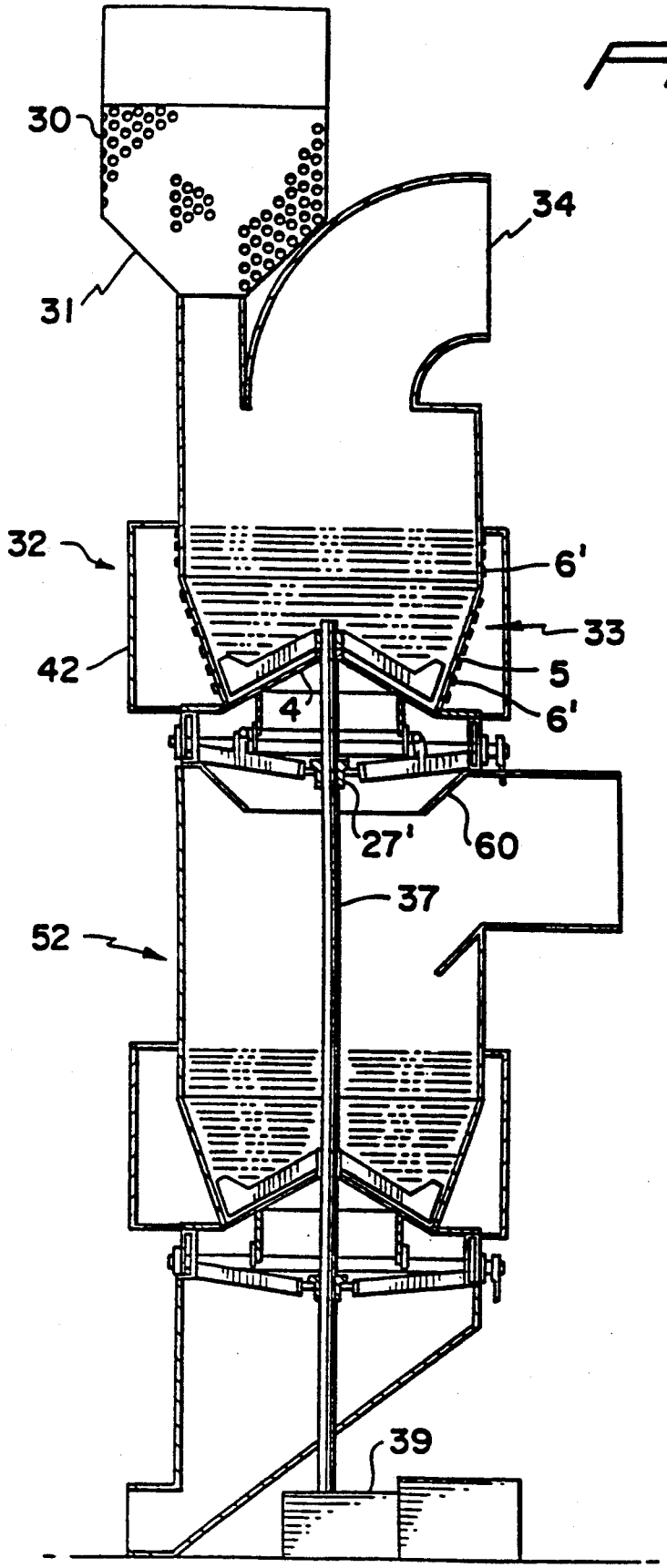
FIG. 7 is a cross-sectional view of a coffee roaster according to a further embodiment of the invention.

As illustrated in FIG. 7, the roasting chamber 32 includes a lower section 33 which contains a plurality of louvers 6' and a cylindrical upper section 10 which is the same diameter as a cylindrical portion of lower section 33. This cylindrical upper section 10 may also include a plurality of openings 6 and louvers 6' in a lower portion thereof and may include a viewing port (not shown). The chamber 32 also includes an opening or vent 34 for exhausting air and the normal chaff produced during the roasting of the coffee.

The lower section 32 is surrounded by an inlet scroll or manifold 42 which directs the air in a direction which is generally or mostly tangentially toward the louvers in the lower section 32. The paddles 26 are rotated in the direction of the louvers by means of shaft 37 and motor drive assembly 39 to aid in the initial rotation of the beans, and heated air at a temperature between 550°-650° F. is pumped in to the manifold 42 and is directed toward the louvers 6' and into the interior of chamber 33 to form and maintain a stable controlled spinning bed of beans.

The manifold 42 may also be connected to a centrifugal blower or spiral impeller (not shown) and is constructed and arranged to direct a flow of heated air through the louvers 6' in the lower section 32 in a mostly tangential direction to spin the coffee beans about a central and vertical axis. This tangentially directed air enters the chamber through, for example, 10 rows of 1 inch louvers with ¾ inch spacings and which are disposed with an upward angle of about 22°. It is presently believed that the upward angle aids in supporting the spinning bed without levitating the beans. The inlet scroll or spiral distributor is, in essence, the reverse of a spiral diffuser and is constructed and arranged so that the air is directed toward the louvers in a tangential direction and in a manner such that the inlet velocity is the same or approximately the same for each louver.

The lower section 32, in an upper part thereof, or in a lower part of upper portion 10 may also include 3 circumferential rows of louvers of about 0.67 inches equally spaced and angled downwardly at about 7, 10 and 15°, respectively, from bottom to top. These rows of louvers are shown as disposed in a right circular cylindrical section and are thought to aid in limiting the amount of climb by the beans up the wall 5 of the chamber 3.

After roasting the beans for about 60-90 seconds, the conically-shaped base 4 is moved upwardly or downwardly in a manner which will be described in more detail hereinafter and the airflow into the chamber may be stopped. In some cases it may not be necessary to discontinue the airflow since the bean spill 20 described above may direct the beans out of the bottom of the chamber within several seconds.

The beans passing out of the roasting chamber 3 pass downwardly through a quench ring 41 and are preferably sprayed with cooling water to reduce their temperature, prevent further pyrolysis and increase the humidity within the coffee beans. The partially cooled beans then drop into a second chamber 52 which is disposed coaxially with and below chamber 33.

After the roasted coffee beans pass through the quench ring 43, they drop into a second chamber 52 which is similar in construction to chamber 3. Chamber 52, may be equally dimensioned and is generally similar to chamber 3. However, chamber 52 is a cooling chamber which uses air at ambient temperature for cooling the beans. Thus, the dumping means for the second chamber 52 is also generally similar to that used for chamber 3, but does not usually but may incorporate a quenching ring for further cooling of the beans.

Figure 10A:
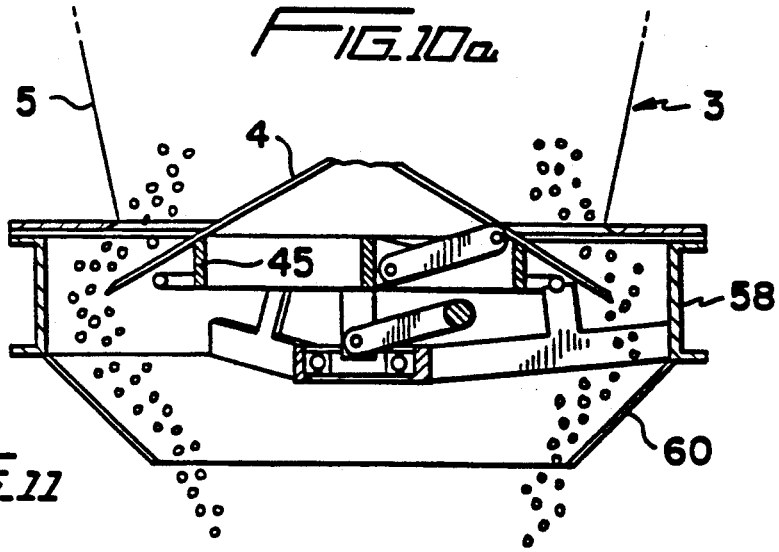
FIG. 10*a* is a cross-sectional view of the means for removing particulate material as shown in FIGS. 9 and 10 but showing the apparatus in an open or dumping mode.

An apparatus for removing the coffee beans from the roasting chamber 3 is illustrated in FIGS. 9, 10 and 10*a* which are plan and cross-sectional views of the dump or chamber emptying mechanism. As illustrated therein, the cone-shaped base 4 is supported by an annular-shaped support member 45 which lowers the base 4 to create an opening between the lower portion of the chamber 3 and the cone-shaped base 4. Thus, the roasted coffee beans may be removed or dumped out of the roasting chamber in the manner shown in FIG. 10*a*. To change from the open or dumping position shown in FIG. 10*a* to a closed or roasting position shown in FIG. 10, an air cylinder which is operatively connected to a source of pressure (not shown) is actuated. Air pushes a piston contained therein outwardly to rotate shaft 51 and lifting arms 53. These lifting arms 53 move the cone-shaped base 4 upwardly until it engages the bottom of chamber 3.

A support arm 55 is also operatively connected to member 45 and acts as an idler arm to prevent tipping of the cone-shaped base 4. The cone support 45 is also supported at a third point so that the lifting or lowering arrangement is generally similar to a three-point hitch such as commonly used on farm tractors.

As shown in FIGS. 10 and 10*a*, the mechanism is supported on a pair of C channels 58 and includes a bean chute 60 for guiding the beans into the lower chamber 52. Also shown is a bearing assembly 27' which permits shaft 37 to rotate with respect to the stationary chamber 3.

In considering the mechanism for opening or closing the chamber and for removing the beans from the chamber, it should be recognized that there will be numerous approaches which will be apparent to those skilled in the art. It should also be recognized that any means for removing the particulate material is within the scope of the appended claims and that the specific mechanism disclosed herein is not an essential part of the invention.

Figure 11:
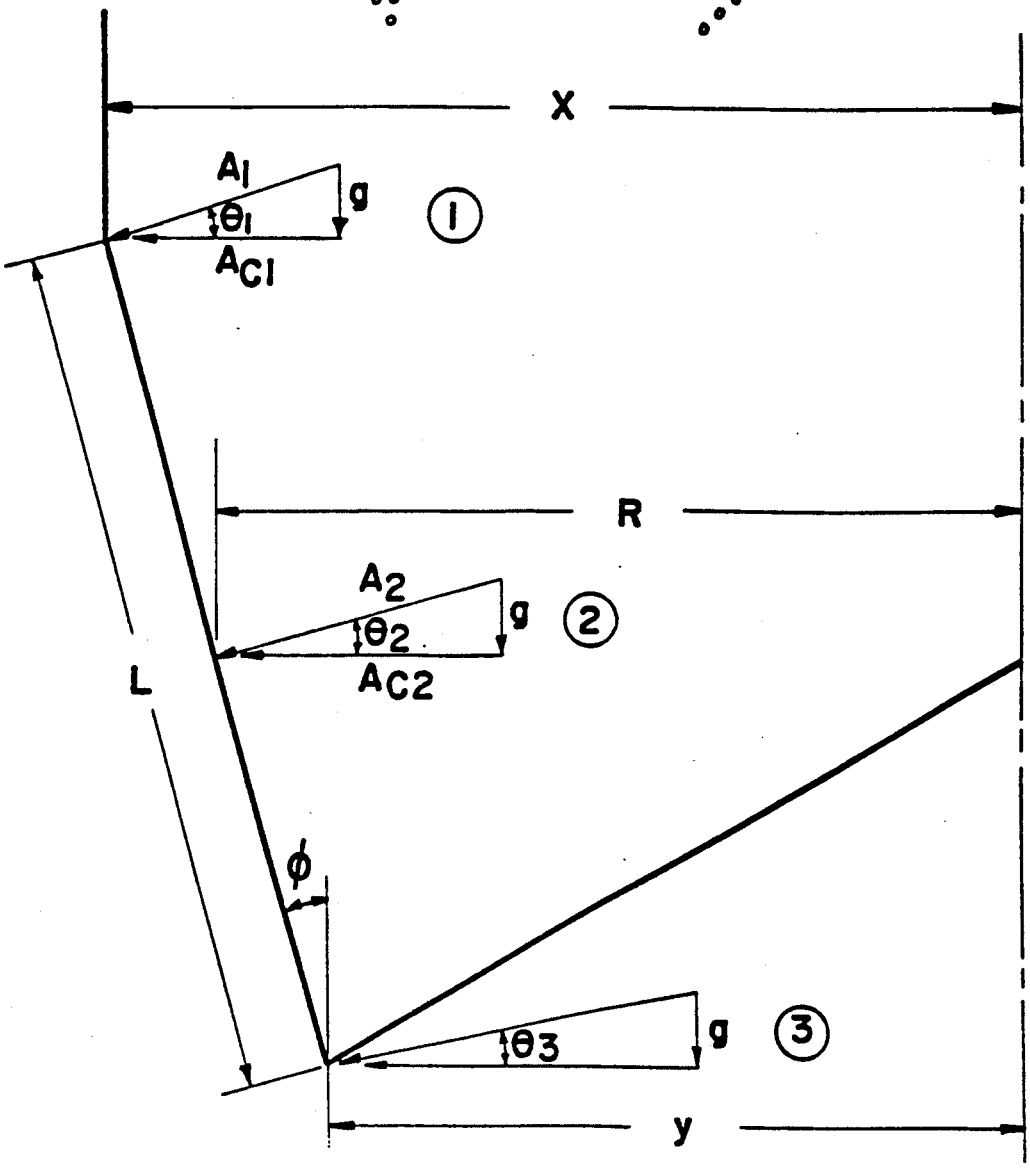
FIG. 11 is a schematic diagram of a partial chamber which illustrates the design parameters in a preferred embodiment of the invention.

In designing an apparatus according to the present invention, there are a number of parameters to be considered. For example, FIG. 11 illustrates the types of calculations used in determining the length of a divergent conical section of a chamber, the average radius of that section, the maximum and minimum radius of that section and the desired angle for the diverging conical section off of vertical. As illustrated therein, the following abbreviations stand for:

$A_0$—Resultant Acceleration Vector on Chamber Wall at Position (1), (2), or (3)

$A_{C0}$—Centrifugal Acceleration Component g—Gravitational Acceleration Component L—Length of Divergent Conical Chamber Sections (DCCS)

R—Average Radius of DCCS

X—Maximum Radius of DCCS

Y—Minimum Radius of DCCS $\theta$—Angle of Acceleration Vector Above Horizontal $\phi$—Desired Angle for DCCS Off of Vertical Using the above, it should be apparent that in order to calculate the chamber dimensions, an individual may:

1) Pick a maximum radius, X, of the chamber and experimentally determine particle velocity, $V_P$, at this radius and a design flow rate of the conditioning medium (usually air). However, it should be recognized that the particle velocity varies somewhat at different velocities due to changes in particle to wall friction.

2) Calculate the centrifugal acceleration, Ac, at radius X according to the following formula:

$$Ac = V_P^2/X \quad (1)$$

3) Calculate angle of acceleration vector, $\theta$ from the following formula:

$$\theta = \mathrm{Tan}^{-1}(g/Ac) \quad (2)$$

4) Pick the length of the divergent conical chamber section (DCCS) to be about equal to the maximum radius, X, and calculate minimum radius, Y from the following formula:

$$Y = X - L \sin\theta \quad (3)$$

5) Calculate the approximate mean radius, R by the following formula:

$$R = (X + Y)/2$$

Thus, the acceleration vector angle for the average radius, R, can be determined from formulas (1) and (2). To illustrate the controlled spinning bed principle more clearly, the inertial acceleration vectors from a particle on the wall will be used. The divergent conical chamber segment angle, $\phi$, is chosen so that the acceleration vector is normal to the surface of the divergent conical chamber segment at the average radius, R, in which case it equals $\theta$ at the average radius. For example, if the divergent conical chamber segment angle is selected greater than $\theta$, the particles have the tendency to rise up the chamber wall. Conversely, if the angle is less, the particles will tend to move down the chamber wall.

It should also be pointed out that using a single divergent conical chamber segment rather than multiple sections each with different $\phi$ angles can be advantageous to increase vertical lifting in the lower part of the chamber and decrease it in the upper part. For example, if $V_P = 10$ feet per second and $X = 1$ foot results in the following values for Ac and $\theta$ at the top, middle and bottom.

| Position | Ac | $\theta$ |
|---|---|---|
| Top (1) | 3.1 g | 18° |
| Mid (2) | 3.7 g | 15° |
| Bot (3) | 4.7 g | 12° |

From the above table, it appears that the optimum angle for the chamber wall varies as a function of the radius which changes from top to bottom of the divergent conical chamber segment. Now, if the divergent conical chamber segment angle is 15°, then at the bottom the correct angle would be 12°; however, by making it 15° the result is that the particles tend to climb up the wall as they rotate around the chamber. As illustrated at number 3 of FIG. 11, the angle that $A_3$ makes with the divergent conical chamber segment is not normal and hence accounts for the upward spiral motion. At Position 2, there is no upward or downward particle movement since vector $A_2$ is normal to the divergent conical chamber segment.

Thus, the general trend from equations (1) and (2) is that the chamber should be more cylindrical at the smaller radii than at large radii. However, for ease of manufacturing, it is desirable to have a conical-shaped chamber as compared to a theoretically more desirable curved surface.

The following table lists approximate dimensions for chambers each with a different maximum radius and different particle velocities.

| X (feet) | L (ft) | Y (ft) | R (ft) | $V_{P\ (ft/sec)}$ | $\theta$ |
|---|---|---|---|---|---|
| 0.2 | 0.20 | 0.14 | 0.17 | 4.0 | 18° |
| 1.0 | 0.92 | 0.67 | 0.84 | 9.0 | 19° |
| 2.5 | 1.75 | 1.67 | 2.08 | 12.0 | 25° |

Selecting two of the three variables (X, $V_P$ and/or $\theta$), the third can be readily calculated.

Another consideration in designing apparatus according to a presently preferred embodiment of the invention resides in the balancing of forces. For example, the sum of the radial drag force on each of the particles shall be less than or equal to the sum of the inertial force on each of the particles to keep the bed in a controlled condition. Referring now to FIGS. 12 and 13, the air enters the chamber in a generally tangential direction, as shown by vector 70 and transfers most of its momentum to particle 72. This causes the particle 72 to revolve about the center of the chamber axis 71. When this occurs, the resultant force vector (consisting of the gravitational and centrifugal components) on the particle changes from downward to a more outward direction from the vertical axis i.e. to a more horizontal direction. Thus, the particles are revolving around the chamber axis and are forced outwardly against the chamber wall which is where the air is coming in with a mostly tangential and small inward radial component. The radial component creates a drag force on the particle tending to carry the particle toward the axis. This drag force is counteracted by the gravitational and centrifugal forces as shown in FIG. 13. The drag force, gravitational force and centrifugal force are given by equations (4), (5) and (6). In general, the gravitational force is less than the centrifugal force since the desired effect is to increase the beans apparent weight within the radial airstream. This can be expressed as $F_D$ is less than or equal to $F_C$.

$$F_D = PV_{RA}C_DA/2 \quad (4)$$

$$F_C = m_PV_P^2/R \quad (5)$$

$$F_g = m_Pg \quad (6)$$

where:

$F_D$ = Force on the particle due to drag from the radial component of the airstream;

P = Density of the airstream;

$V_{RA}$ = Radial component of airstream velocity;

$C_D$ = Coefficient of drag for specified particle;

A = Area of particle normal to $V_{RA}$

Fc = Centrifugal or inertial force on rotating particle;

$m_P$ = Mass of rotating particle;

$V_P$ = Tangential velocity of rotating particle;

R = Radius of rotating particle;

g = Gravitational acceleration; and $F_g$ = Force on the particle due to gravity.

The louvers 6' referred to previously herein are illustrated in more detail in FIGS. 14, 14a and 15. As illustrated therein, a louver in the lower portion of chamber 3 is preferably angled upwardly to provide a slight lifting force to the particles. In essence, this lifting force will tend to lift the spinning bed upwardly against the wall 5 of chamber 3. At times, it may also be desirable to provide a lifting force by an upwardly angled louver in the lower portion of the chamber and at the same time to provide a series of louvers which are angled downwardly in an upper portion of the chamber as an aid in controlling and mixing the particles in the spinning bed, as shown in FIG. 14A.

While the invention has been described in connection with several preferred embodiments, it should be understood that numerous modifications and changes may be made without departing from the scope of the appended claims.

What is claimed is:

1. Apparatus for conditioning particulate material comprising a chamber for receiving a charge of particulate material, means for forming a controlled spinning quasi-packed bed of the material within said chamber and with relative movement with respect to said chamber, said means for forming the controlled spinning bed of material including fluid flow means for passing a fluid into and through the controlled bed of material and in which the fluid flow and design parameters are such that the radial drag forces on the particles are less than the inertial forces of the particles to thereby maintain the bed in a controlled condition.

2. Apparatus for conditioning particulate material according to claim 1 in which the fluid flow enters said chamber generally tangentially and in which the means for subjecting the controlled bed of material to a conditioning step comprises means for subjecting the material to a change in temperature.

3. Apparatus for conditioning particulate material according to claim 2 which includes means for heating the fluid which passes through said fluid flow means so that the means for conditioning the controlled bed heats the controlled bed to an elevated temperature.

4. Apparatus for conditioning particulate material according to claim 3 which includes separate means for cooling the controlled bed.

5. Apparatus for conditioning particulate material according to claim 1 which includes means for mixing the particulate material with the spinning packed bed.

6. Apparatus for conditioning particulate material according to claim 2 in which said chamber has a generally circular cross-section with a generally upright axis and a sloping wall against which the controlled spinning bed is forced.

7. Apparatus for conditioning particulate material according to claim 6 in which the centrifugal force of the spinning particulate material is greater than the radial drag force on the particulate material.

8. Apparatus for conditioning particulate material according to claim 7 in which said chamber is stationary during the conditioning of the controlled spinning bed of material.

9. Apparatus for conditioning particulate material according to claim 8 in which said means for forming a controlled spinning bed of the material forces the particulate material in an outer portion of the bed upwardly along said sloping wall and circumferentially about the central axis.

10. Apparatus for conditioning particulate material according to claim 3 in which said fluid flow is heated air.

11. Apparatus for conditioning particulate material according to claim 9 which includes means for directing a portion of the controlled spinning bed from the top of the packed bed toward the bottom of said chamber.

12. Apparatus for conditioning particulate material according to claim 11 in which centrifugal force against each particle is at least three times the ordinary weight of the particle.

13. Apparatus for heating particulate vegetable material comprising a chamber for receiving the particulate vegetable material having a generally circular base and an upwardly extending divergent wall defining a segment of a cone with a central axis and a plurality of openings in said wall, means for heating a fluid mass, means for inducing the heated fluid mass generally tangentially into said chamber to rotate the vegetable material about the axis with relative movement with respect to said chamber and for maintaining the rotating vegetable material in a relatively densely packed state during the heating thereof, exit means in an upper portion of said chamber for allowing the heated fluid mass and any chaff produced thereby to leave the chamber and means for removing the material from said chamber, and in which the generally vertical axis of said chamber is vertical and in which the included angle between the chamber wall and a horizontal plane as its base is about 70°, and in which the plurality of openings in said wall are in a lower portion thereof and said wall further defines a plurality of louvers adjacent the openings, and in which said base of said chamber is solid and defines a right circular cone that extends upwardly into said chambers, an outer wall around said chamber to thereby define a plenum and means for directing a flow of heated air into the plenum in the direction toward the inner surface of said louvers and tangential to said chamber to cause the particulate material to rotate about the vertical axis at a speed which will impart a centrifugal force on the particles such that their apparent weight is at least 2.5 times their actual weight and such that the particulate material will be formed into a rotating centrifugally packed mass with the outer particles forced against and upwardly along said wall, a rotatable mechanical arm disposed in the lower portion of said chamber adjacent the surface of said convex base member and means for rotating said arm to sweep the surface of said base and assist in the rotation of said particles, means defining a circular cross section and an upwardly extending convergent wall abutting the top of said chamber for preventing upward movement of the particulate material beyond a predetermined level, and plate means disposed at the top of the centrifugally packed bed at an outer portion thereof at an angle with respect to a horizontal plane taken along the top of the centrifugally packed bed with a portion thereof extending downwardly into the bed so that a portion of the particulate material will be directed downwardly toward the bottom of said chamber.

14. Apparatus for roasting a mass of particulate material comprising a first chamber for receiving a charge of particulate material, means for forming a centrifugally packed bed of the material within said chamber, means for heating the centrifugally packed bed of material to a roasting temperature, a second chamber and means for transferring the roasted particulate material to said second chamber, means for forming a centrifugally packed bed of roasted material within said second chamber, means for cooling said centrifugally packed bed of roasted material and means for removing the cooled material from said second chamber.

15. Apparatus for roasting a mass of particulate material according to claim 14 in which said second chamber is disposed below said first chamber.

16. Apparatus for roasting a mass of particulate material according to claim 15 in which said first and second chamber are disposed on a common axis.

17. A process for roasting particulate vegetable material comprising the steps of:

a) providing a generally upright chamber;

b) introducing a charge of particulate vegetable material into the chamber;

c) forming a spinning centrifugally packed bed of particulate vegetable material within the chamber and with relative movement with respect to the chamber;

d) heating the centrifugally packed bed of particulate vegetable material to a roasting temperature of at least 204° C.; and e) removing the roasted particulate vegetable material from said chamber.

18. A process for roasting particulate vegetable material according to claim 17 wherein the sum of the radial drag forces on each particle in the spinning centrifugally packed bed are no greater than the radial inertial forces of each of the particles.

19. A process for roasting particulate vegetable material according to claim 18 which includes the step of cooling the roasted particulate vegetable material.

20. A process for roasting particulate vegetable material according to claim 18 which includes the step of transferring a portion of the particulate vegetable material from the top of the centrifugally packed bed to the bottom of said chamber.

21. A process for roasting particle vegetable material according to claim 20 in which the centrifugally packed bed defines a segment of a cone with a hollow center and in which the inner and outer surfaces of the bed are generally parallel.

22. A process for roasting particulate vegetable material according to claim 21 in which the particulate vegetable material in the centrifugally packed bed is continuously moved upwardly at the outer periphery of the bed but prevented from moving upwardly beyond a predetermined level.

23. A process for roasting particulate vegetable material according to claim 20 which includes the step of providing a generally upright and generally circular chamber defining a segment of a cone with a central axis, heating a mass of air and introducing the mass of air into the chamber in a generally tangential direction to thereby rotate the particulate vegetable material about the central axis.

24. A process for roasting particulate vegetable material according to claim 23 in which the rotation of the particulate vegetable material is mechanically assisted.

25. A process for roasting particulate vegetable material according to claim 18 which includes the steps of providing a second generally upright chamber, transferring the roasted particulate vegetable material to the second chamber, forcing a centrifugally packed bed of roasted particulate vegetable material in the second chamber, cooling the centrifugally packed bed of roasted particulate vegetable material and removing the cooled roasted particulate vegetable material from the second chamber.

26. A process for conditioning particulate material comprising the steps of:

a) providing a generally circular upright chamber with a central axis for receiving a charge of particulate material;

b) forming a centrifugally packed bed of the material within the chamber and with relative movement with respect to the chamber by rotating the particulate material about the central axis so that the centrifugal force of the spinning particulate material is greater than the radial drag force on the particulate material;

c) subjecting the centrifugally packed bed of material to a conditioning temperature; and d) removing the particulate material from the chamber.

27. A process for conditioning particulate material according to claim 26 in which the centrifugally packed bed is formed by a mass of heated air which flows in a tangential direction toward the chamber.

* * * * *